United States Patent [19]

Hintsch

[11] 4,422,482

[45] Dec. 27, 1983

[54] GUIDE TOOTH FOR A WEAVING MACHINE

[75] Inventor: Otto Hintsch, Wallisellen, Switzerland

[73] Assignee: Sulzer Brothers Limited, Winterthur, Switzerland

[21] Appl. No.: 322,584

[22] Filed: Nov. 18, 1981

[30] Foreign Application Priority Data

Dec. 2, 1980 [CH] Switzerland ..... 8886/80

[51] Int. Cl.[3] ..... D03D 49/60

[52] U.S. Cl. ..... 139/188 R; 139/435

[58] Field of Search ..... 139/188 R, 435

[56] References Cited

U.S. PATENT DOCUMENTS 2,833,315 5/1958 Dunham ..... 139/188

3,667,508 6/1972 Inglin ..... 139/188

4,328,842 5/1982 Scheffel ..... 139/435

FOREIGN PATENT DOCUMENTS 2031033 4/1980 United Kingdom ..... 139/435

*Primary Examiner*—Henry Jaudon

*Attorney, Agent, or Firm*—Kenyon & Kenyon

[57] ABSTRACT

The guide tooth of the weaving machine has an upper leg with a straight outside edge for passage through the spot threads in the low shed position in parallel relation. The length of the straight edge is greater than the interval between pairs of successive tangling points in the spot threads to insure entry between the threads without damaging the threads.

5 Claims, 3 Drawing Figures

I
I'
II
II'
III
III'
1
2
3
4
5
6
7
8
9
11
12
13
14
17
18
21
22
23
24
A
L

GUIDE TOOTH FOR A WEAVING MACHINE

This invention relates to a guide tooth for a weaving machine.

As is known, weaving machines and power looms employ guide teeth for the formation of a weft insertion channel for guiding a picked weft into a shed of warp threads. Conventionally, the guide teeth are constructed, for example as described in German P.S. No. 11 92 986, such that each tooth has a free leg which separates the warp threads when the tooth moves into the shed. Generally, the section of the tooth which first touches the warp threads and thereafter separates the warp threads is provided with a curved outer edge. However, a weaving machine or power loom which is provided with such guide teeth is unable to work certain warp threads, especially the so-called spot yarns, e.g. air tangled or air mingled threads. These threads consist of single parallel extending fibrils, the cross-connection of which (i.e. connection by air tangling) is provided only at relatively long intervals, for example 0.7 to 1.2 centimeters. In these cases, the known guide teeth can penetrate between the fibrils and can become caught therein. This, in turn, can destroy the thread.

Accordingly, it is an object of the invention to provide a guide tooth which can be utilized to work spot threads in the warp.

It is another object of the invention to provide a guide tooth which can penetrate between spot threads without damaging the threads.

Briefly, the invention provides a guide tooth for a weft path in a weaving machine wherein the tooth has a free leg with a straight outside edge for entering between two warp threads in parallel relation.

The guide tooth permits a weaving machine to work on a spot thread, for example an air tangled yarn, in the warp in which the interval between two successive cross-section connectin points of the fibrils of the threads is not greater than the straight outside edge of the guide tooth. Because of the straightness of the outside edge, the guide tooth enters between the warp threads to be divided or separated simultaneously along the entire length of the outside edge.

If the interval between two successive connection points of a warp thread is not greater than the straight outside edge of the guide tooth, the guide tooth strikes against at least one connection point of the thread in any event. As a result, the warp thread cannot be pierced or split open by the guide tooth. Instead, the warp thread will, in any case, place itself as whole on one side or the other side of the guide tooth as the guide tooth enters into the shed more and more.

These and other objects and advantages of the invention will become more apparent from the following detailed description taken in conjunction with the accompanying drawings wherein.

Figures 1, 2, 3:
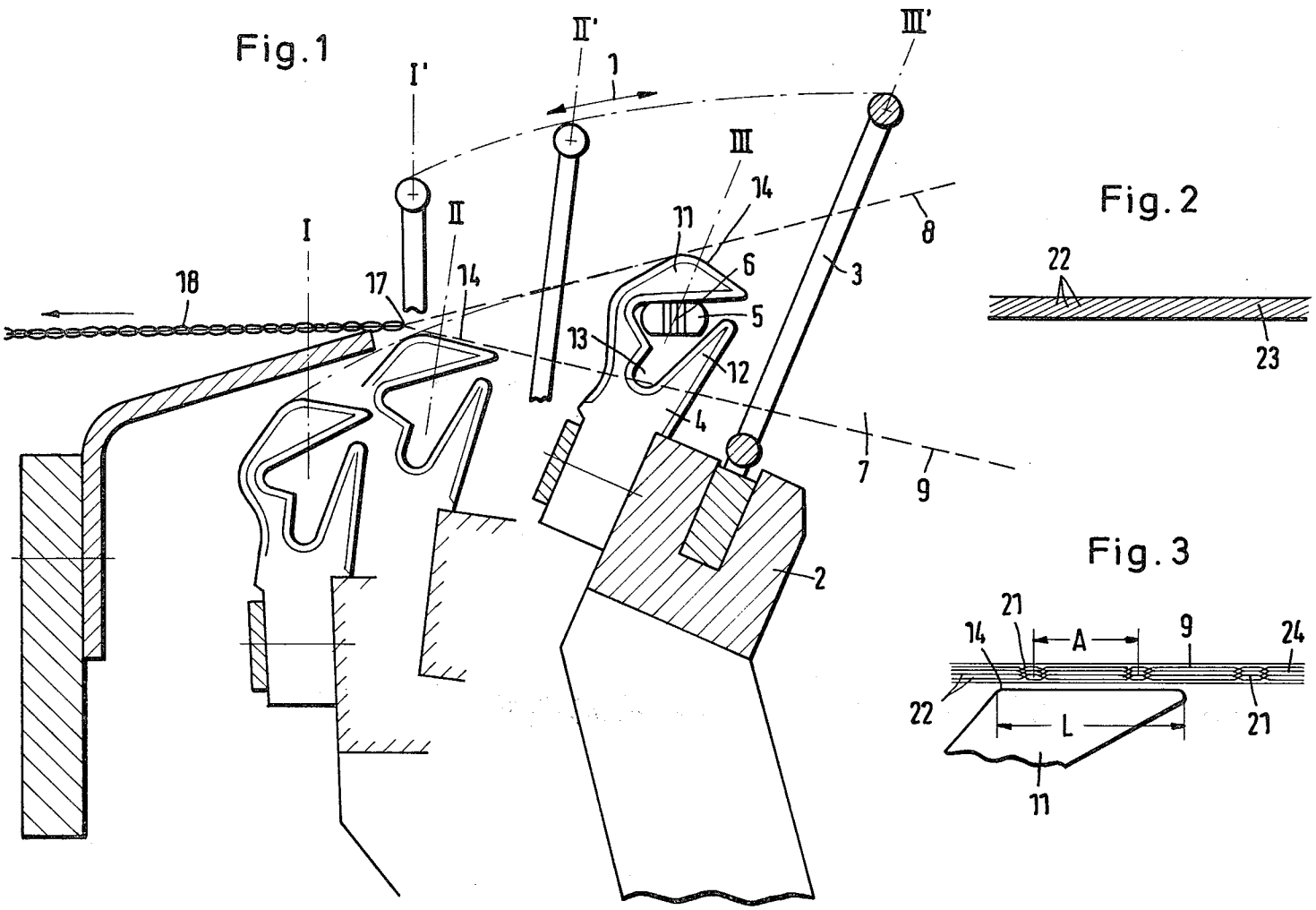
FIG. 1 illustrates a cross-sectional view of a part of a weaving machine employing a guide tooth according to the invention.
FIG. 2 illustrates a schematic view of a normally twisted thread.
FIG. 3 illustrates a schematic view of a spot thread.

Referring to FIG. 1, the weaving machine is provided with a sley 2 which reciprocates in the direction indicated by the arrow 1. This sley 2 carries a reed 3 and a plurality of guide teeth 4 which are arranged to define a weft guide channel for a projectile 5 carrying a weft thread 6. The sley 2 cooperates with a means (not shown) for forming a shed 7 of warp threads 8, 9 in known fashion. As indicated, the warp threads 8 are in the high shed position and the warp threads 9 are in the low shed position.

Each guide tooth 4 has a pair of legs 11, 12 which define the guide path or channel 13 for the weft projectile 5. The upper leg 11 is formed in a cantilevered or free manner and has a straight upper edge 14 extending from the end of the leg 11.

During operation, after completion of a weft insertion, the sley 2 together with the reed 3 and guide teeth 4 is swung from the positon III—III' to the position I—I' in which the weft thread 6 is beaten against a beat-up point 17 of the forming fabric 18. Before the next weft insertion, the sley 2, reed 3 and guide teeth 4 are again swung back towards the position III—III'. In so doing, these components 2, 3, 4 pass through the position II—II' in which the straight outside edge 14 of each guide tooth 4 is in parallel to the warp threads 9 in the low shed position.

As indicated in FIG. 3, each warp thread 8, 9 is formed of an air-tangled yarn 24 which contains air tangling points 21 by which individual fibrils 22 which run parallel to each other are held together. As indicated, the interval A between two tangling points 21 is less than the length L of the outside edge 14 of a guide tooth 4. For example, the interval A may be between 0.7 to 1.2 centimeters. In this case, the length L of the edge 14 of the guide tooth 4 is greater than 1.2 centimeters. In this case, the edge 14 will strike against a tangling point as the guide tooth 4 passes into the shed 7. Thus, the air-tangled warp thread 9 cannot be pulled asunder or split by the guide tooth 4.

For purposes of comparison, FIG. 2 illustrates a normally twisted thread 23 having a plurality of fibrils 22 arranged in a twisted manner relative to each other.

It is to be noted that the guide tooth can also be used for the formation of a guide channel of a power loom in which weft insertion is effected by means of an air jet or water jet.

The invention thus provides a guide tooth which can be utilized with spot warp threads without breaking or damaging the threads.

What is claimed is:

1. In a weaving machine having means for forming a shed of air tangled warp threads between a low shed position and a high shed position, a sley having a plurality of guide teeth for defining a weft path through said shed, each said tooth having a free upper leg with a straight outside edge for entering into said shed between two of the warp threads in said low shed position, said edge being parallel to the warp threads in said low shed position at a point adjacent said low shed position whereby upon entry into said shed the threads of said low shed position are not split by said teeth.

2. In a weaving machine as set forth in claim 1 wherein said edge has a length greater than 1.2 centimeters.

3. In a weaving machine as set forth in claim 1 wherein said edge has a length greater than the distance between successive connection points in the thread.

4. In a weaving machine as set forth in claim 1 wherein each said tooth has a second leg for defining a guide path for a weft between said legs.

5. In a weaving machine as set forth in claim 1 wherein said upper leg of each tooth has a second edge extending angularly from an end of said straight edge.

* * * * *